United States Patent [19]

Carmelo

[11] 3,976,247

[45] Aug. 24, 1976

[54] LOW-TEMPERATURE MELTING METALS SPRAY-GUN

[76] Inventor: Maniglia Carmelo, 3/3 Via Ippolito d'Aste, Genoa, Italy, 16100

[22] Filed: Dec. 22, 1975

[21] Appl. No.: 643,057

[30] Foreign Application Priority Data

Dec. 23, 1974 Italy ..... 13105/74

[52] U.S. Cl. ..... 239/135; 239/79; 239/346; 239/373; 222/146 H

[51] Int. Cl.[2] ..... B05B 1/24

[58] Field of Search ..... 239/79, 80, 85, 128, 239/133, 134, 135, 139, 311, 318, 337, 340, 341, 346, 354, 373; 222/146 H, 146 HE

[56] References Cited

UNITED STATES PATENTS

| | | | |
|---|---|---|---|
| 1,792,551 | 2/1931 | Rice et al. | 239/346 X |
| 2,434,911 | 1/1948 | Denyssen | 239/79 X |
| 2,746,883 | 5/1956 | Powers | 239/79 X |
| 3,776,462 | 12/1973 | Payne | 239/346 X |

FOREIGN PATENTS OR APPLICATIONS

| | | | |
|---|---|---|---|
| 531,839 | 1/1941 | United Kingdom | 239/79 |

*Primary Examiner*—Robert S. Ward, Jr.
*Attorney, Agent, or Firm*—Pollock, Vande Sande & Priddy

[57] ABSTRACT

A low temperature melting metal such as tin, is contained in a small pot, heated by the flame of a burner. The metal is drawn from the bottom of the pot through a spray nozzle by venturi action of an air jet which forcefully throws molten droplets of metal against the surface to be coated. Means associated with the pot are provided to preheat the air stream before it comes into contact with the molten metal. Advantageously, the pot is closed by a cover, and air under pressure is supplied to the top of the pot, so as to force the molten metal towards the spray nozzle.

7 Claims, 3 Drawing Figures

LOW-TEMPERATURE MELTING METALS SPRAY-GUN

BACKGROUND OF THE INVENTION

Low temperature melting metals spray devices are known, in which the molten metal is contained in an electrically heated open pot provided at its bottom with a spray nozzle comprising an inner nozzle communicating with the interior of the pot, and a concentric outer nozzle connected to a suitable source of compressed air, so as to draw the molten metal out of the pot through the nozzle by venturi action, throwing it in form of small droplets against the surface to be coated.

The main disadvantage of the prior art molten metals spray devices of the kind described resides in the fact that the compressed air jet entraining the molten metal droplets expands at the exit from the spray nozzle, thus cooling the entrained metal droplets. The said cooling effect is very objectionable, particularly in those cases in which it is necessary to maintain the temperature of the molten metal in the heated pot at a temperature slightly above and very close to the melting point temperature of the metal being sprayed, due to the heat perishable nature of the objects to be coated. In fact, under the above conditions, the said cooling may cause the solidification of the metal droplets before they reach the surface to be coated.

A further disadvantage of the said prior art molten metals spray devices resides in the fact that under certain circumstances of temperature of the molten metal in the pot, the venturi action of the air jet is not sufficient to drawn the molten metal from the pot through the spray nozzle.

SUMMARY OF THE INVENTION

The present invention aims to overcome the above and other disadvantages of the known low-temperature melting metals spray devices.

It is therefore the main object of the present invention to provide a low-temperature melting metals spray gun comprising in combination a pot for the metal to be sprayed, means for heating said pot, a spray nozzle mounted at the bottom of said pot and comprising an innermost nozzle communicating with the interior of the pot through a needle valve, and a concentric outer nozzle element communicating with an air feed duct, a handle secured to said pot and provided with manually operable trigger means controlling the operation of the needle valve of the metal spray nozzle and the operation of a cut-off valve mounted in a duct connected at one end to a compressed air source and at its other end to the inlet of an air circulating chamber mounted in heat exchange relation with the said pot, and having its outlet connected to the air feed duct of the outer nozzle element, so as to pre-heat the air supplied to said nozzle to the temperature of the molten metal contained in the pot.

According to a further feature of the invention, the said pot is closed at its upper end by a cover, conduit means being provided for supplying conpressed air into said pot at a position above the level of the molten metal contained in the pot. According to a still further feature of the present invention, holder means are secured to the lower end of the said handle for securing to the said handle a burner heating the said pot, the said holder means being further provided with rest means for the abutment of the forearm of the user of the molten metal spray gun.

Further objects and advantages of the present invention will become apparent from the following specification of a preferred embodiment of the invention, made with reference to the accompanying drawings.

DESCRIPTION OF THE PREFERRED EMBODIMENT OF THE INVENTION

Figures 1, 2:
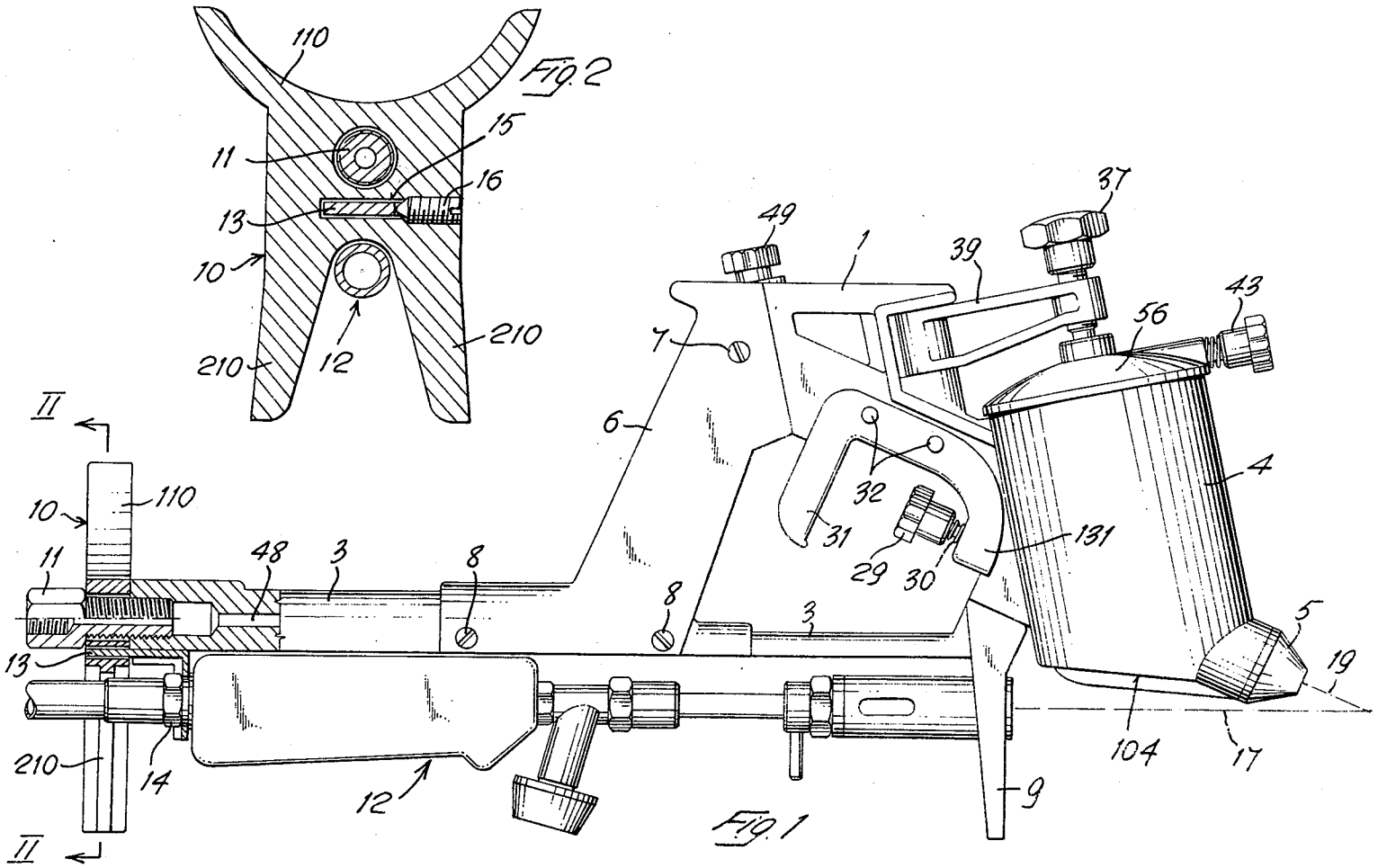
FIG. 1 is a side view of the molten metals spray gun according to the invention.
FIG. 2 is a cross sectional view taken along line II—II of FIG. 1.
Figure 3:
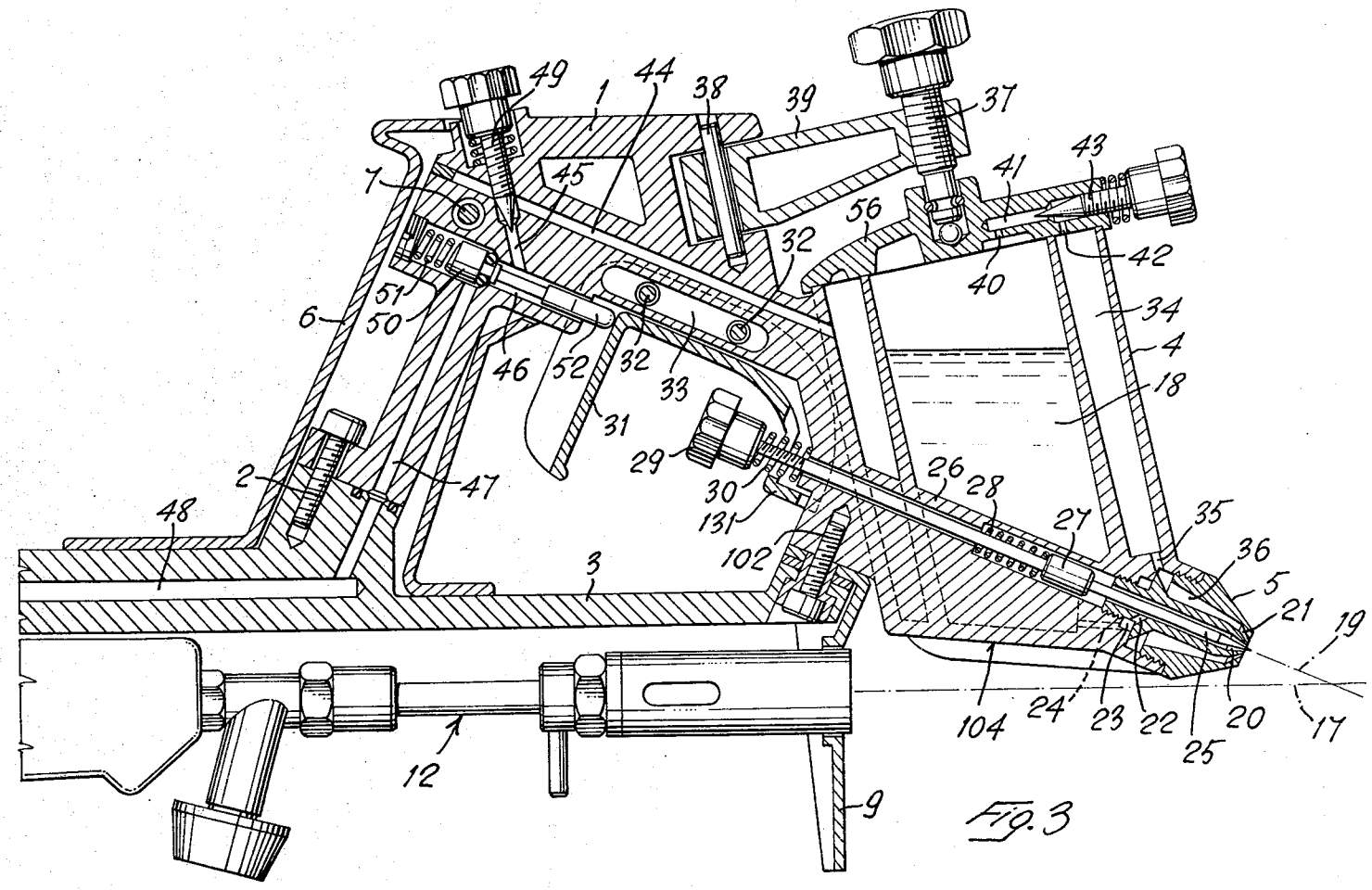
FIG. 3 is a longitudinal sectional view of the spray gun of FIG. 1, in enlarged scale.

With reference to the drawings, numeral 1 denotes a pistol-like body, to the lower end of which a rod-like holder 3 is fastened by means of screws 2 and 102. Integral with the body 1 is the pot 4. The pot 4 is provided at its front in the region of its bottom with a spray nozzle 5. A handgrip 6, formed by two shells, is fastened by means of screws 7 and 8 to the rear end of body 1 and to holder 3. A downwardly extending inverted V shaped foot 9 is secured to the forward end of the holder 3 by means of screw 102. To the rear end of the holder 3 a bearing member 10 is secured by means of nipple 11 screwed into the rear end of holder 3. The said bearing member 10 comprises a downwardly extending, inverted V-shaped foot element 210 and an upwardly extending, U-shaped forearm rest element 110.

An oxyacetilene burner 12 of conventional construction is to the lower end of holder 3. To this end, to the rear end of the burner handle a bracket 13 is secured by one shank by means of the nut 14, the other shank of bracket 13 being inserted into a slot 15 formed in the foot member 210, and fastened thereto by means of the fastening screw 16 which is screwed into a screw-threaded bore opening sidewise into slot 15.

The forward end of burner 12 is passed through a bore formed in foot 9, so as to heat the bottom 104 of pot 4. In this respect, it will be noted that the longitudinal axis 17 of burner 12 is substantially parallel to the bottom 104 of pot 4. The longitudinal axis 19 of spray nozzle 5 is inclined with respect to the axis 17 of burner 12, so as to form and oblique angle with that axis. Spray nozzle 5 is provided with a central port 20 for the molten metal, and with a concentric anular gap 21 for the spray gas.

Part 20 of nozzle 5 is connected through a radial duct 22, an anular chamber 23 and a duct 24 with the inside of pot 4, which is provided at its interior with a diametral rib 26 extending a certain distance upwardly from the bottom of pot 4. The said rib 26 is provided with a bore coaxial with the axis of the port 20. Needle valve 25 is slidably mounted in said bore. Valve 25 is normally to a position in which it closes port 20 by a spring 28 mounted between a shoulder formed in the bore of rib 26 and an abutment member 27 secured to the stem of needle valve 25. A knob 29 is screwed to the rear end of the stem of needle valve 25, and a spring 30 is disposed between the said knob and body 1, urging valve 25 in a direction in which the said valve opens port 20.

The force exerted on valve 25 by spring 30 is however less than the force exerted on the valve by spring 28, and it is thus possible by means of adjusting knob 29, to adjust the overall pressure exerted on valve 25 in the direction of closure of port 20.

Numeral 31 denotes the trigger of the spray gun. The said trigger 31 is slidably supported by body 1 by means of two pins 32 which are guided through a slot 33 formed in body 1. Integral with trigger 31 is a downwardly projecting extension 131, provided with a slot though which spring 30 and the shaft of needle valve 25 are freely guided. Pot 4 is provided with an outer cylindrical jacket 34 communicating through a duct 35 and annular chamber 36 with port 21 of the spray nozzle. Pot 4 and jacket 34 are closed in an airtight manner by means of a cover 56. Cover 56 is rotatably secured to the lower end of a locking screw 37, which is screwed into one threaded bore formed at one end of a swivel arm 39 which is rockably secured to the body 1 at its other end through a swivel pin 38. Jacket 34 is connected with the upper end of the pot 4 via port 42, adjustable needle valve 43, duct 41 and port 40 formed in cover 56. Jacket 34 is further conected via duct 44 formed in body 1, needle valve 49, duct 45, duct 46, valve 50, duct 47 and duct 48 formed in the holder 3, to the nipple 11 connected to a source of compressed air (not shown). Valve 50, which intercepts communication between ducts 46 and 47, is normally urged to its closure position by a spring 51, and is provided with a valve stem 52 extending outwardly of body 1 through duct 46 into contact with the rear surface of trigger 31.

OPERATION OF THE DESCRIBED DEVICE

In operation, the pot is first opened by unscrewing screw 37, and oscillating sidewise the cover 56 connected to swivel arm 39. Thereafter, pot 4 is filled with the desired low melting metal such as zinc, tin, lead or a suitable low melting metals alloy. The pot is thereafter again closed by rocking cover 56 above pot 4, and screwing the locking screw 37.

Burner 12 is next ignited, with its flame licking the bottom 104 of pot 4. After sufficient heating time, i.e., after the metal in pot 4 has been completely melted, the operation of the spray gun may be started.

To this end, the operator grips the spray gun by handgrip 6, putting his finger on the trigger 31. The forearm of the operator rests on the rest element 110, so as to achieve optimum balancing of the gun. When a pull is exerted on the trigger, valve 50 is first urged into its opening position, by the action of valve stem 52, against the action of spring 51. The compressed air from the air source (not shown) is fed through nipple 11, duct 48, duct 47, open valve 50, duct 46, duct 45, open valve 49, duct 44, into jacket 34 in which it is heated, and from jacket 34 through port 42, open valve 43, duct 41 and port 40 into the upper end of pot 4, thus establishing a certain pressure above the level of the liquid metal 18 in pot 4. From jacket 4 the air is further discharged through port 35, chamber 36 to the exterior through port 21 of the nozzle 5.

When trigger 31 is pulled further, the extension 131 is first brought into abutment with knob 29, and thereafter by continuing its movement, it entrains knob 29 and thus valve 25 connected to knob 29 in its opening position, against the action or spring 28, thus opening port 20. The liquid metal 18 in pot 4 may thus flow through duct 24, chamber 23, duct 22 through port 20 of spray nozzle 5, where it is entrained by the air jet flowing through port 21. The venturi action of the air jet flowing through port 21 is enhanced by the pressure exerted on metal 18 by the air flowing in pot 4 through port 40. The said action is very desirable whenever the liquid metal in pot 4 is maintained at a temperature slightly above its melting point.

To stop the metal spraying from nozzle 5, it is sufficient to release the pull on trigger 31. In fact, valves 50 and 25 will automatically be urged to their closed positions by springs 51 and 28.

Valves 43 and 49 are adjusted manually so as to obtain the desired air pressure in nozzle 5 and in pot 4.

Thanks to the fact that the air jet is preheated before it leaves nozzle 5, the objectionable effects of the prior art devices mentioned above may be overcome, and it is thus possible to operate with the metal in pot 4 heated to a temperature very close to its melting point, as is required whenever heat perishable materials are to be coated with metal.

Although the preferred embodiment of the invention has been described according to which the air is preheated in a jacket surrounding pot 4, which inter alia has the valuable effect of providing heat insulation for the melting pot, it is to be understood that the air may be pre-heated in any suitable chamber in heat exchange relation with pot 4, and for instance the outlet of duct 44 may be connected to the inlet of a suitable coil disposed in pot 4, the outlet of which is connected to duct 35.

I claim:

1. A low temperature melting metals spray gun comprising in combination a pot for the metal to be sprayed, means for heating said pot, a spray nozzle mounted at the bottom of said pot and comprising an innermost nozzle communicating with the interior of the pot through a needle valve, and a concentric outer nozzle communicating with an air feed duct, a handle secured to said pot and provided with manually operable trigger means controlling the operation of the needle valve of the metal spray nozzle and the operation of an air cut-off valve mounted in a duct connected at one end to a compressed air source and at its other end to the inlet of an air circulating chamber mounted in heat-exchange relation with said pot, and having its outlet connected to the air feed duct of said outer nozzle.

2. A low temperature melting metals spray gun according to claim 1, further comprising a removable cover for closing the said pot in an air tight manner, and conduit means for supplying compressed air into said pot at a position below said cover and above the level of the molten metal in said pot.

3. A low temperature melting metals spray gun according to claim 1, in which the said air circulating chamber is in the form of a cylindrical jacket surrounding said pot.

4. A low temperature meltng metals spray gun comprising in combination a pot for the metal to be sprayed, means for heating said pot, a spray nozzle mounted at the bottom of said pot and comprising an innermost nozzle communicating with the interior of the pot through a needle valve and a concentric outer nozzle, a handle secured to said pot and provided with manually operable trigger means controlling the operation of the needle valve of the metal spray nozzle and the operation of an air cut-off valve mounted in an air feed duct connected at one end to a compressed air source, a cylindrical jacket, open at its upper end, surrounding said pot, duct means for connecting said jacket to said air feed duct and to said concentric outer nozzle, a removable cover for closing in an air tight manner said pot and the upper end of said concentric cylindrical jacket, and conduit means in said cover for connecting the interior of said jacket to the interior of said pot at a position above the level of the molten metal in said pot.

5. A low temperature melting metals spray gun according to claim 1, further comprising holder means secured to the lower end of said handle for removeably fastening a burner, said holder means being further provided with rest means for the forearm of the user of the spray gun.

6. A low temperature melting metals spray gun according to claim 4, in which valve means are provided in said conduit means in said cover for adjusting the valve of the pressure of the air supplied to said pot.

7. A low temperature melting metals spray gun according to claim 1, in which said heating means comprises a burner disposed so as to heat the bottom of said pot, the pot bottom being substantially parallel or slightly inclined with respect to the longitudinal axis of said burner.

* * * * *

UNITED STATES PATENT AND TRADEMARK OFFICE

CERTIFICATE OF CORRECTION

PATENT NO. : 3,976,247

DATED : August 24, 1976

INVENTOR(S) : Maniglia Carmelo

It is certified that error appears in the above-identified patent and that said Letters Patent are hereby corrected as shown below:

[76] Inventor: Maniglia Carmelo

SHOULD BE:

[76] Inventor: Carmelo Maniglia

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*